US010227852B2

(12) United States Patent
Jimenez Vallejo

(10) Patent No.: US 10,227,852 B2
(45) Date of Patent: Mar. 12, 2019

(54) RECLAIMING MACHINE OF FLUIDS IN WELLS

(71) Applicant: Pablo Leónidas Jimenez Vallejo, San Andres Cholula (MX)

(72) Inventor: Pablo Leónidas Jimenez Vallejo, San Andres Cholula (MX)

( * ) Notice: Subject to any disclaimer, the term of this patent is extended or adjusted under 35 U.S.C. 154(b) by 174 days.

(21) Appl. No.: 15/212,369

(22) Filed: Jul. 18, 2016

(65) Prior Publication Data

US 2017/0022792 A1 Jan. 26, 2017

(30) Foreign Application Priority Data

Jul. 24, 2015 (MX) ..... A/2015/009574

(51) Int. Cl.
*E21B 27/00* (2006.01)
*E21B 27/04* (2006.01)
*E21B 43/12* (2006.01)

(52) U.S. Cl.
CPC ..... *E21B 43/126* (2013.01)

(58) Field of Classification Search
CPC ..... E21B 27/00; E21B 27/04
See application file for complete search history.

(56) References Cited

U.S. PATENT DOCUMENTS 1,489,986 A * 4/1924 Davison ..... E21B 27/00 166/52
4,086,035 A * 4/1978 Klaeger, Jr. ..... E21B 27/00 166/168

* cited by examiner

*Primary Examiner* — Catherine Loikith
(74) *Attorney, Agent, or Firm* — Wiggin and Dana LLP; Joseph Casino; Jonathan D. Hall

(57) ABSTRACT

A reclaiming machine for fluids in wells, which performs strokes on a cyclical basis up to the bottom of the casing pipe of the well, collecting fluids brought to the surface and drawing them from the well by gravity. The reclaiming basket is the component performing the downstroke towards the bottom of the casing pipe of the well, to submerge in the hydrocarbon to be collected, and then begin the upstroke with the hydrocarbon collected, stored at the top of the pickup basket, to draw it from the well by gravity through the unloading head. Included in an embodiment is a pickup basket having communication ports, a positive check valve, and a gear motor. When the upstroke concludes, the collected fluid is directed through an unloading coupling and stored in a unloading tank and directed where it is required.

10 Claims, 3 Drawing Sheets

RECLAIMING MACHINE OF FLUIDS IN WELLS

FIELD OF THE INVENTION

The following invention is applicable in the industrial area as a machine to reclaim fluids in wells, interacting directly with new parts and components which are installed and work traveling throughout, within the casing pipe of the well, reclaiming and extracting hydrocarbons found in liquid form at the bottom of the well, and drawing them from the well by gravity through the machine to reclaim fluids in wells, increasing the daily reclaiming volume of these fluids, among other benefits.

BACKGROUND

Fluids extraction in wells is an ancient practice that goes from the most traditional, with the construction of shallow wells without any casing pipe and the collection at the bottom and the extraction of fluids to the surface, where the extraction of the well is done using buckets hoisted with a rope, to the most complex and sophisticated systems, such as those used in the oil industry, where the casing pipe of the well is installed with features and special metallurgy, installing it throughout the well, including the producing area, where the hydrocarbons to extract are found. The fluids coming from the producing area enter the well and continue their displacement to the surface coming out of the well by their own energy. These wells are called naturally flowing wells, when the hydrocarbon energy depletes within the producing area as a result of the low gas content in the oil solution. We are in the presence of the so called artificial lift wells, where it is necessary the use of machinery, techniques and systems to draw the remaining fluids at the bottom of the well. Nowadays, the oil industry has an important amount of wells in which hydrocarbon must be sought where it is, in the depth, machines, techniques and systems are expensive consequently it is necessary to install permanently pipes, parts and equipment within the casing pipe of the well, and on the surface to place machinery to move and operate the parts and equipment installed in the casing pipe of the well, and this requires much more energy in its operation, and personnel in the field who are monitoring and repairing this machinery. One of the most commonly used systems is called mechanical pumping. Production pipes are installed in the casing pipe of the well, which come from the producing area to the surface connected section by section in the form of a string, and the mechanical anchor is placed in the lower pipe which is located opposite to the producing area, which is attached to the casing pipe of the well, to prevent the movement of the production pipes. Within the production pipes the down-hole pump with reciprocating mechanism is lowered, and this pump is attached by screwing, at the top, a continuous rod assembly, which reaches the surface as a continuous string. In the last rod on the surface, the tubular parts of final adjustment are screwed to connect to the walking beam machine which is located on the right side of the well on the surface. The walking beam machine supplies all the energy to the rod string and to the down-hole pump with a reciprocating mechanism. This walking beam machine has uninterruptedly reciprocating cyclical movements downward and upward and, with these movements, the down-hole pump with reciprocating mechanism moves and activates, i.e., when it descends draws the fluid from the producing area introducing it into the production pipes, and when it ascends compresses the fluid that is within the production pipes, pushing the oil out of the well on the surface.

The mechanical pumping system has problems such as the frictional wear of its parts, the rods are in constant contact with the production pipes and the interrupted movement between these two components ends up breaking by fatigue. All production pipes, parts and equipment that are installed permanently within the casing pipe of the well generate an investment for clients since they have to buy these materials, i.e., the walking beam machine is rented per daily rate, qualified personnel are required to technically inspect three times a week the whole mechanical pumping system in order to ensure its proper operation and, if necessary, make the required repairs. This is a system used by the industry but with a high investment cost per well: 120 thousand US dollars for the purchase of parts and equipment installed in the well, and 7 thousand US dollars, the cost of monthly rent, for the walking beam machine.

SUMMARY

The machine we are presenting solves many of the current problems of the mechanical pumping described above, and the special development of this invention contributes to new parts and methods for collecting fluids regarding mechanical pumping. The new pickup basket, used for collection and transportation of hydrocarbon from the bottom of the well to the surface, eliminates the frictional wear between metal parts and repairs of the machine components, reducing time for repairs and increasing productivity by time efficiency. The pickup basket submerges in the fluid to be collected at the bottom of the casing pipe of the well, to a depth per linear meter required by the client and, thus, all fluid stored above the pickup basket is the fluid volume that will come out of the well, increasing the amount of fluids collected in each cycle, being able to reach up to 2 barrels per cycle. Thus, the efficiency of the machine also increases when extracting, from the casing pipe of the well, a larger volume of hydrocarbons per day. All components which are installed, moved and operated are inside of the casing pipe of the well and never leave the well, avoiding and eliminating any spill or hydrocarbon pollution on the surface. It is noteworthy to mention that the operating cost of the present invention is much lower than that of mechanical pumping. This pickup machine of fluids for wells only bills for the daily rental of the entire system, and does not charge for parts or equipment installed and operating within the well.

BRIEF DESCRIPTION OF DRAWINGS

For a greater understanding of the object of the present invention, i.e., a machine to reclaim fluids in wells has been illustrated in several Figures presented in the preferred embodiments, all by way of example, wherein it is expressed.

DETAILED DESCRIPTION

Figure 1:
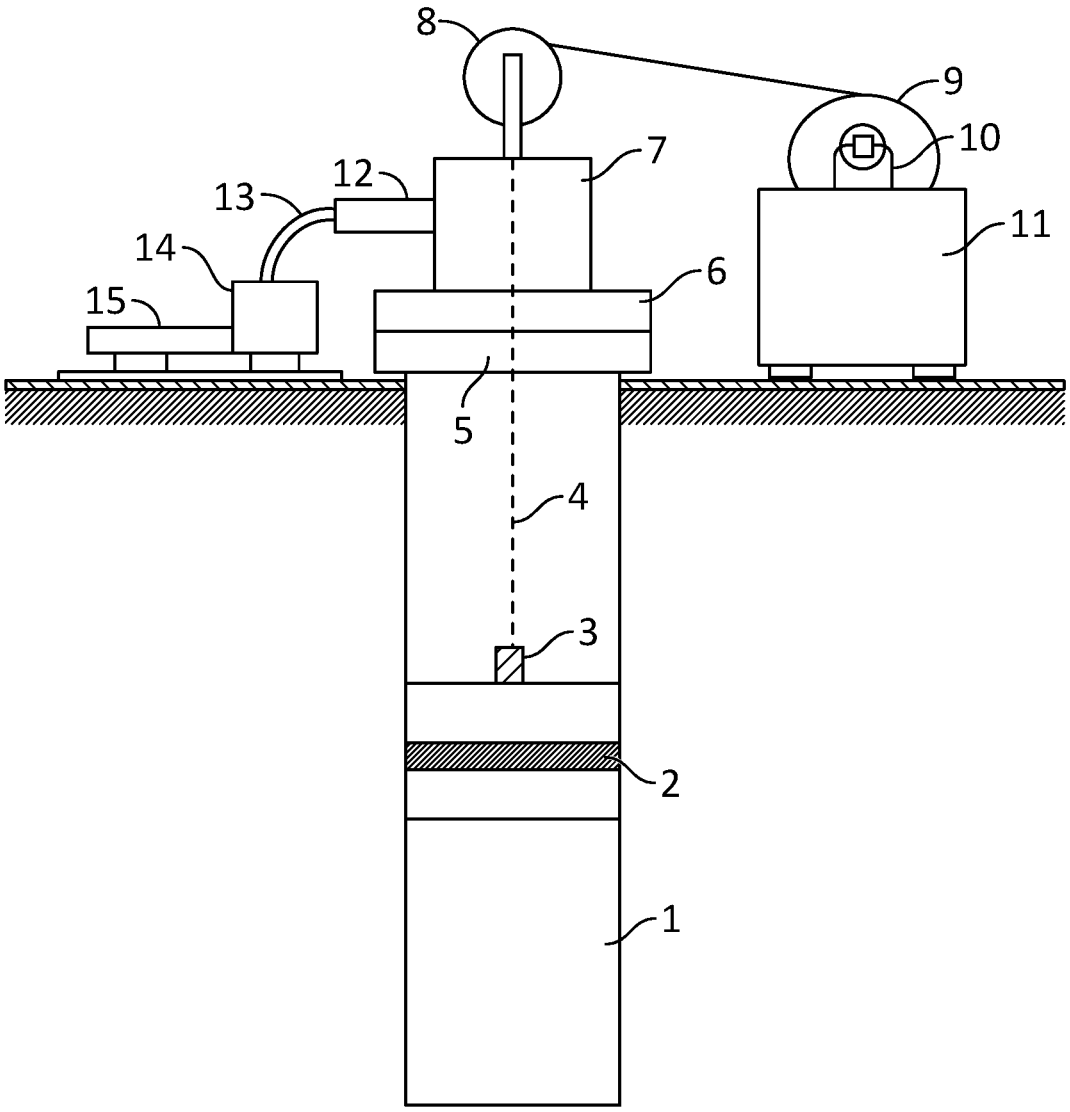
FIG. 1 is a side elevation view that shows the complete and general scheme of the pickup machine of fluids of wells of the present invention, installed in a well.

In FIG. 1 it can be seen that the machine for reclaiming of fluids in wells, object of the present invention, comprises a pickup basket 2, which is manufactured with a length of 1 m. Weight varies depending on the viscosity of the hydrocarbon to be extracted, i.e., if API is 7 to 14 it weighs 45 kilograms, if API is 15 to 32 it weighs 38 kilograms, with a maximum outer diameter of 0.159 cm (1/16 inch) less than the inner diameter of the casing pipe of the well 1. The pickup basket 2 extends along the entire casing pipe of the well 1, travelling throughout from the surface to the bottom of the casing pipe of the well. The fishing head 3 is located on the top central part of the pickup basket 2, which has profiles on its tip, which are geometrically identical to the fishing tools. The function of the fishing head 3 is to remove, from the casing pipe of the well 1, the pickup basket 2 if the power cable 4 breaks and the pickup basket 2 falls to the bottom of the casing pipe of the well 1. The power cable 4 is attached and tied up to the fishing head 3, and the power cable 4 is passed through the adapter flange 5 which is manufactured as combination, with a configuration at the top, different to that in the lower part. The lower part of the adapter flange 5 is coupled and screwed to the head of the well 6. All the oil wells on the surface have the head of the well 6. The power cable 4 passes through the unloading head 7, and this unloading head 7 is coupled and screwed at the top of the adapter flange 5. The unloading head 7 has two holes at the top, one to install the guide pulley 8, through which the power cable 4 slides and aligns when it comes out of the casing pipe of the well 1. The guide pulley 8 has inside elastomeric elements tightening to the power cable 4 for cleaning the hydrocarbon dripping in its two movements, when it is introduced and descends into the casing pipe of the well 1 and as it comes out of the casing pipe of the well 1, preventing fluid spills outside the casing pipe of the well 1. The power cable 4 extends from the pickup basket to the coil 9 arranged on a base with bearings in the main cabinet 11, in which the power section of the machine for reclaiming of fluids in wells is located. In this section it is the gear motor 10 energizing the coil 9 where the power cable 4 is wound. The gear motor 10, in downward position, allows the power cable 4, connected to the pickup basket 2, to descend within the casing pipe of the well 1 to the depth where the hydrocarbon is collected. The gear motor 10, in upward position, removes from the well the power cable 4 connected to the pickup basket 2, and the hydrocarbon collected that is stored on the top during the stroke to the surface. The second hole, which is at the top of the unloading head 7, is used to connect the unloading coupling 12 which is screwed directly to the unloading head 7 and, on the other end, has a suddenly fast attachment which, in turn, attaches to the unloading hose 13 which is made of rubber and with an outer diameter of 3 inches or an outer diameter of 2.75 inches, and which connects to the unloading tank 14, which has a capacity of two barrels. In the unloading tank 14, the collected fluid of the casing pipe of the well 1 is stored and taken out by the pickup basket 2 to the surface, passing the collected fluid through the unloading head 7. The unloading tank 14 is used to calibrate the efficiency of fluids extraction of the reclaiming machine of fluids in wells. A measurement of the volume of fluid extracted in each cycle (called cycle to the downstroke, the waiting time for collecting the fluid, the upstroke to the surface and the discharge of the fluid collected on the surface) is performed by the pickup basket 2, then the suction pump 15 transfers all fluid stored in the unloading tank 14 where the client indicates it, which can be a storage tank, or pumps it directly to a production battery. The suction pump 15 has the capacity to work with absolute pressures of 600 psi and, with these values of absolute pressure, the suction pump 15 is capable of placing the fluid contained in the unloading tank 14 in a production battery which is 45 km away.

Figures 2A, 2B, 2C, 2D:
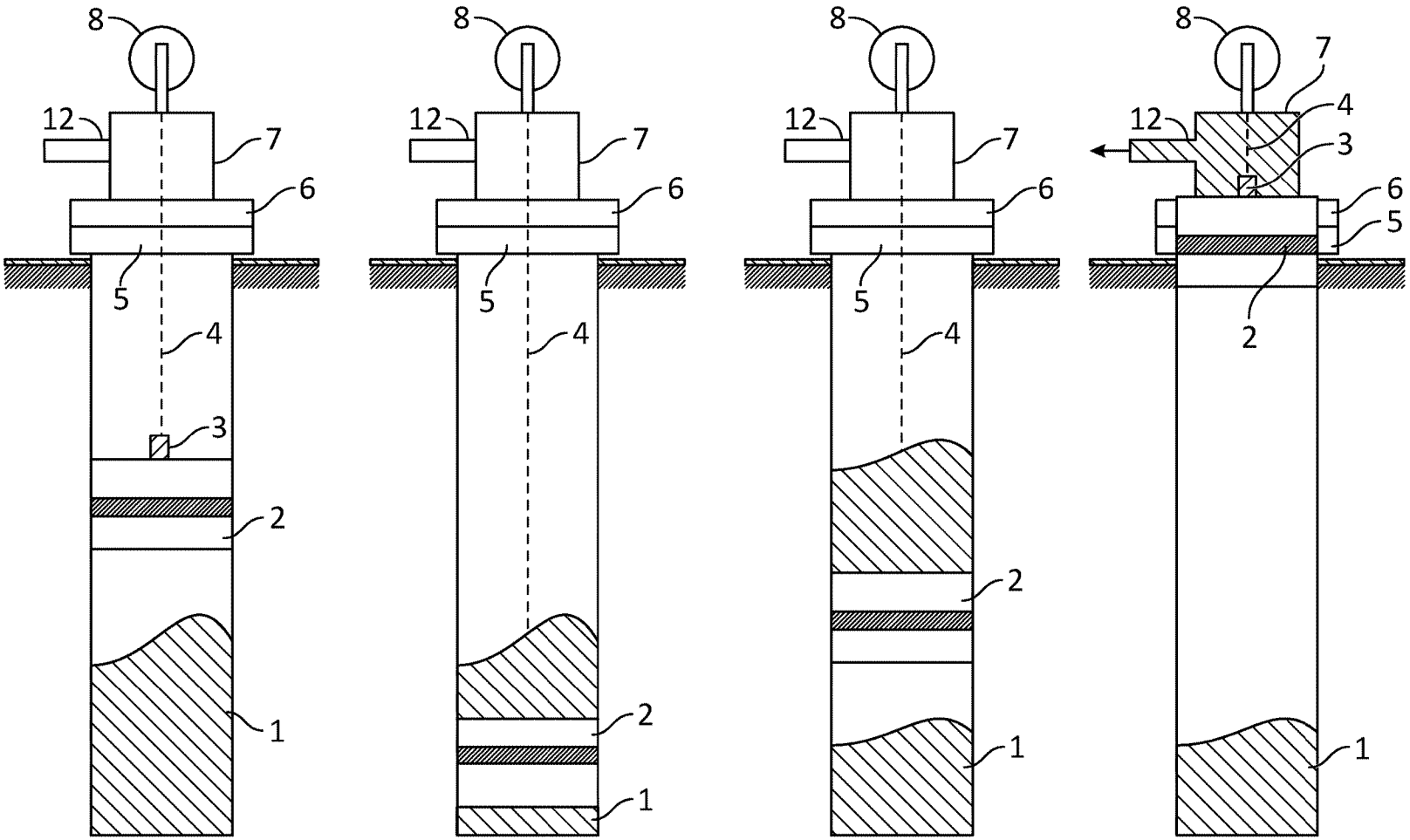
FIG. 2A is a side elevation view that shows the pickup basket in downstroke within the casing pipe of the well.
FIG. 2B is a side elevation view that shows the pickup basket submerged in the fluid at the bottom, within the casing pipe of the well.
FIG. 2C is a side elevation view that shows the pickup basket in upstroke within the casing pipe of the well, with the collected fluid stored at the top of the pickup basket.
FIG. 2D is a side elevation view that shows the pickup basket compressing the collected fluid, compressing it in turn against the inner wall of the unloading head, drawing it from the well by gravity through the unloading coupling.

FIGS. 2A to 2D show the machine for reclaiming of fluids in wells, installed in an oil well. FIG. 2A shows the pickup basket 2 in downward stroke within the casing pipe of the well 1, to submerge in the hydrocarbon that is at the bottom of the casing pipe of the well 1. Its lowering speed is 3.3 ft./s and is controlled by the gear motor 10 installed in the main cabinet 11. FIG. 2B shows the pickup basket 2 submerged in the hydrocarbon. At this stage of the cycle, the pickup basket 2 stops two minutes to let pass all the fluid that is below it and which will raise through the communication ports 16 to stay above it. These two minutes are used for the fluid to rest and stabilize, and can be collected efficiently. FIG. 2C shows how the pickup basket 2, in upstroke, takes on top the collected hydrocarbon, its rate of ascent is 2 min/s and is controlled by the gear motor 10 installed in the main cabinet 11. FIG. 2D shows how the collected fluid is compressed against the inner wall of the unloading head 7 and the hydrocarbon comes out by gravity through the unloading coupling 12 and the unloading hose 13 to be deposited in the unloading tank 14, where it remains until the section pump is activated and drains all the fluid contained in the unloading tank 14. The cycle ends and begins again in FIG. 2A.

Figure 3B:
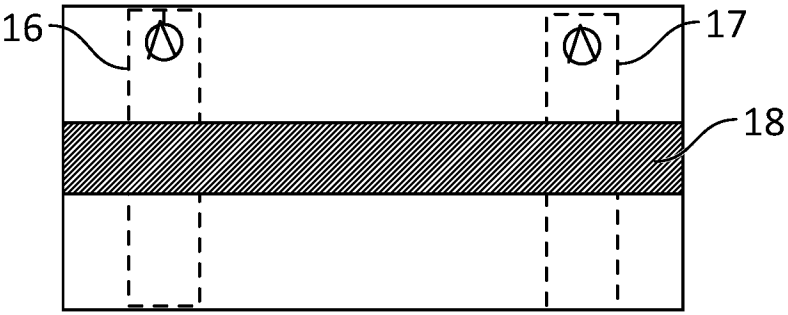
FIG. 3B is a side elevation view that shows the pickup basket with two of the three communication ports; at the top of the communication ports the positive check valve is shown, in the central part of the pickup basket the elastomer that surrounds it 360 degrees is shown, and that is a barrier preventing fluid, collected and stored at the top of the pickup basket, from dripping in the stroke towards the well surface.
Figure 3A:
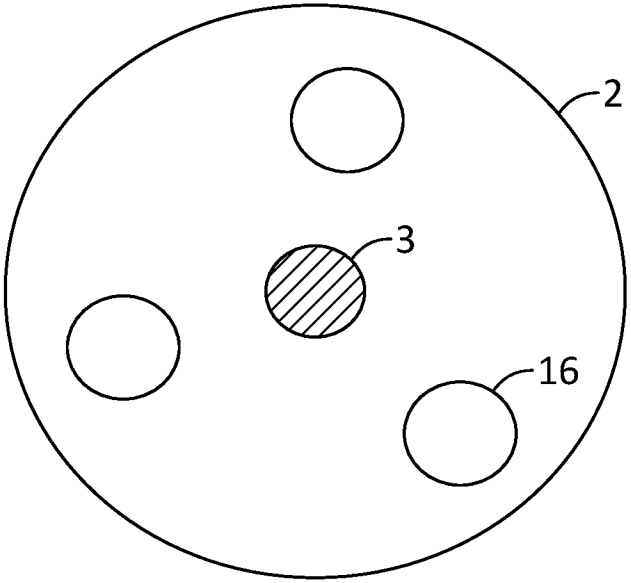
FIG. 3A is a top elevation view of the pickup basket where the three communication ports are seen at the top and, in the middle of the pickup basket, the fishing head.

FIGS. 3A to 3B show the pickup basket 2 and, in detail in FIG. 3A, a top view of the pickup basket 2 where the three communication ports 16 drilled in the solid piece of the pickup basket 2 are. These communication ports have a diameter of 1.5 inch and a length of 39.37 inches, and go through the entire pickup basket 2. At the center of the pickup basket the fishing head 3 is installed. FIG. 3B shows a cross-section of the pickup basket 2 where the communication ports 16 are located, and at the top of each communication port 16, a positive check valve 17 is installed to allow only the passage of fluid from the bottom of the pickup basket 2 towards the top, and prevent the passage of fluid collected at the top of the pickup basket 2 towards the bottom of the same. The elastomer 18, located in the middle of the pickup basket 2, is the retention barrier of the collected fluid in the upstroke of the pickup basket 2, preventing the collected fluid from dripping between the space existing between the maximum outer diameter of the reclaiming basket and the maximum inner diameter of the casing pipe of the well 1.

What is claimed:

1. A machine for reclaiming hydrocarbon fluids in a well, comprising:

a pickup basket, configured to traverse along a casing pipe of the well so as to reach a bottom of the well in a downstroke and reach a surface of the well in an upstroke, thereby transporting a collected hydrocarbon fluid to the surface of the well;

an adapter flange that, at a lower part, is coupled to a head of the well and, at an upper part, is coupled to an unloading head;

a power cable, coiled at a first end on a base with bearings in a main cabinet, the main cabinet containing a power section;

wherein the power cable passes through a guide pulley and the adapter flange and is coupled at a second end to the pickup basket;

a gear motor in the power section energizing the coil, wherein during the downstroke the gear motor allows the power cable and the pickup basket to descend within the casing pipe to a depth where the hydrocarbon fluid is located, and the gear motor, during the upstroke, removes from the well to the surface a portion of the power cable such that at the end of the upstroke, hydrocarbon fluid collected above an upper surface of the pickup basket is compressed against an inner wall of the unloading head and the fluid, by gravity, is drawn from the casing pipe of the well through an unloading coupling which is connected to one of a plurality of holes of the unloading head;

an unloading hose coupled at a top end to an unloading coupling and at a bottom end to the unloading tank, configured to allow fluid coming from the well through the unloading head to flow to the unloading tank; and a suction pump configured to transfer the fluid stored in the unloading tank to a storage tank or a production battery.

2. The fluid reclaiming machine of claim 1, wherein the pickup basket has machined in its body three communication ports each having, at a top, a positive check valve allowing the fluid to pass only upwardly but preventing the fluid from returning downwardly towards the bottom of the well; a fishing head at a top center of the pickup basket, which has profiles geometrically identical to a fishing tool and being configured to assist in drawing the pickup basket from the well if the power cable breaks and the pickup basket falls to the bottom of the well; the pickup basket having, in its central part, an elastomer that surrounds it 360 degrees, which is a barrier preventing the fluid, collected and stored at the top of the pickup basket, from dripping during the upstroke.

3. The fluid reclaiming machine of claim 1, wherein the power cable, in the downstroke, regulates a lowering speed of the pickup basket at 3.3 ft./s; the pickup basket submerging in the fluid to be collected at the bottom of the casing pipe of the well, where after the gear motor, in the upstroke, is configured to wind the power cable into the coil, drawing the fluid collected at the top of the pickup basket up from the well, and at the end of the upstroke, compressing the fluid collected against the inner wall of the unloading head and where after the fluid collected flows from the unloading head by gravity.

4. The fluid reclaiming machine of claim 1, wherein the guide pulley is configured to align the power cable as it slides through the guide pulley; and the guide pulley further having inside elastomeric elements configured to tighten against the power cable so as to prevent hydrocarbons dripping in the same when the power cable is drawn out of the casing pipe of the well.

5. The fluid reclaiming machine of claim 1, wherein the adapter flange has a top configured to mate with a configuration of the unloading head screw thereto, and, the adapter flange further having a lower part configured to mate with a configuration of the head of the well, in which it couples and screws.

6. The fluid reclaiming machine of claim 1, wherein the unloading head has a first hole and a second hole at a top, one of which is used to install the guide pulley, through which the power cable slides and aligns; the unloading head having the second hole at the top which is used to connect the unloading coupling which is screwed directly to the unloading head at a first end of the unloading coupling and the unloading coupling having a second end having an attachment to the unloading hose; the unloading head coupling and screwing to a top of the adapter flange.

7. The fluid reclaiming machine of claim 1, wherein the unloading coupling is coupled to one of the holes of the unloading head, having an angle of 90 degrees and a diameter of at least 3 inches to quickly dislodge the collected fluid of the casing pipe of the well.

8. The fluid reclaiming machine of claim 1, wherein the unloading hose is coupled at its top end to the unloading coupling and at a bottom end to the unloading tank; the hose having an inner diameter of at least 3 inches to quickly dislodge the fluid coming from the unloading coupling.

9. The fluid reclaiming machine of claim 1, wherein the unloading tank is configured to store the collected fluid of the casing pipe of the well, which has a capacity of two barrels; the unloading tank calibrating an amount of barrels obtained from the pickup basket in each cycle.

10. The fluid reclaiming machine of claim 1, wherein the suction pump, being helicoidal and drawing the fluid contained in the unloading tank and carrying it where the client indicates it, either to the general storage tank or to the production battery; the suction pump having a working pressure of at least 600 psi whereby the suction pump is capable of pumping the fluid contained in the unloading tank up to a production battery which is 45 km away.

* * * * *